US006315116B1

(12) United States Patent
Suggs et al.

(10) Patent No.: US 6,315,116 B1
(45) Date of Patent: Nov. 13, 2001

(54) GOLF BAG WITH SEAT ASSEMBLY

(75) Inventors: Gregory M. Suggs, Phoenix; Nicholas Gilbert; Gregory J. Schmidt, both of Glendale, all of AZ (US)

(73) Assignee: Karsten Manufacturing Corp., Phoenix, AZ (US)

( * ) Notice: Subject to any disclaimer, the term of this patent is extended or adjusted under 35 U.S.C. 154(b) by 0 days.

(21) Appl. No.: 09/632,101

(22) Filed: Aug. 3, 2000

(51) Int. Cl.[7] ..... A63B 55/00

(52) U.S. Cl. ..... 206/315.5; 206/315.3; 190/8

(58) Field of Search ..... 206/315.8, 315.3, 206/315.5; 190/1, 8, 12 A

(56) References Cited

U.S. PATENT DOCUMENTS 1,549,647 * 8/1925 Worthington ..... 190/8
5,176,253 * 1/1993 Perrin et al. ..... 206/315.5
5,289,958 * 3/1994 Jay ..... 224/155
5,566,825 * 10/1996 Price ..... 206/315.5
5,915,551 * 6/1999 Vavro ..... 206/315.5
5,957,349 * 9/1999 Krulik ..... 224/115 X

* cited by examiner

*Primary Examiner*—Gene Mancene
*Assistant Examiner*—Tri M. Mai
(74) *Attorney, Agent, or Firm*—Darrell F. Marquette

(57) ABSTRACT

A golf bag having a seat assembly upon which a golfer may sit to rest. When the golfer desires to sit down, a specially configured storage pocket is opened, and a generally U-shaped support rod is moved from a retracted position to an extended position so that a foldable seat, preferably made of fabric, is in a taut stretched condition adjacent a top end of the storage pocket. The foldable seat is attached to a bight portion of the generally U-shaped support rod and is in a folded condition when the support rod is in its retracted position.

14 Claims, 3 Drawing Sheets

GOLF BAG WITH SEAT ASSEMBLY

BACKGROUND OF THE INVENTION

This invention relates in general to golf equipment and, more particularly, to a golf bag having a seat assembly.

Golf bags of the type commonly referred to as "carry bags" are very popular with golfers who wish to walk while playing golf because it allows them to carry their golf clubs instead of using a pull cart or a motorized cart to ease the burden of a much heavier full size golf bag. While carry bags facilitate the carrying of golf clubs while walking, a golfer will sometimes become fatigued while playing and the ability to sit down and rest is often desirable. Also, when play is delayed for any reason, the golfer may be more comfortable if he or she can sit down while waiting. Since the ground on golf courses is often wet or at least damp, sitting on the ground is usually not an option. Occasionally, a golfer will lay the golf bag down and sit on the golf bag while waiting for play to resume. However this is not a good idea since damage to the golf bag and/or the golf clubs may result from this practice.

SUMMARY OF THE INVENTION

In accordance with the present invention, a new and useful golf bag having an extensible seat assembly is disclosed.

The golf bag of the present invention is configured to include a generally tubular body and a stand such as that of the type of stand disclosed in U.S. Pat. No. 4,834,235. Briefly, the stand is provided for supporting the tubular body in a leaning but generally upright propped-up position. Further, the golf bag is provided with a storage pocket proximate a lower portion of the body for carrying golf balls, tees and other accessories or equipment the golfer may need or want to carry. Such storage pockets usually have a zipper at their top end to permit access to the pocket. The storage pocket provided on the disclosed golf bag is slightly larger than customary, and the extensible seat assembly of the present invention is disposed therein.

When the body is propped up on the stand, i.e. in a parked position, it will be leaning at an acute angle of approximately 30 degrees relative to a plane perpendicular to the ground. When leaning in this attitude, the golfer can open the storage pocket and extend the seat assembly for use. When the seat assembly is retracted, it is folded inside the pocket.

The seat assembly includes a generally U-shaped support rod having a bight portion with a pair of legs depending from opposite ends of the bight portion. The legs are arranged to diverge relative to each other. The support rod is disposed within the pocket so that the bight portion thereof is proximate the pocket top end with its legs extending downwardly and passing through openings formed in the tubular body so that depending ends of the legs protrude from the pocket into the body.

The golf bag includes a base member formed with a pair of opposed grooves and the depending ends of the support rod legs are disposed in those grooves. The legs are slidably movable in the pair of grooves so that the bight portion of the support rod can be moved away from the tubular body.

DESCRIPTION OF THE PREFERRED EMBODIMENT

Figure 1:
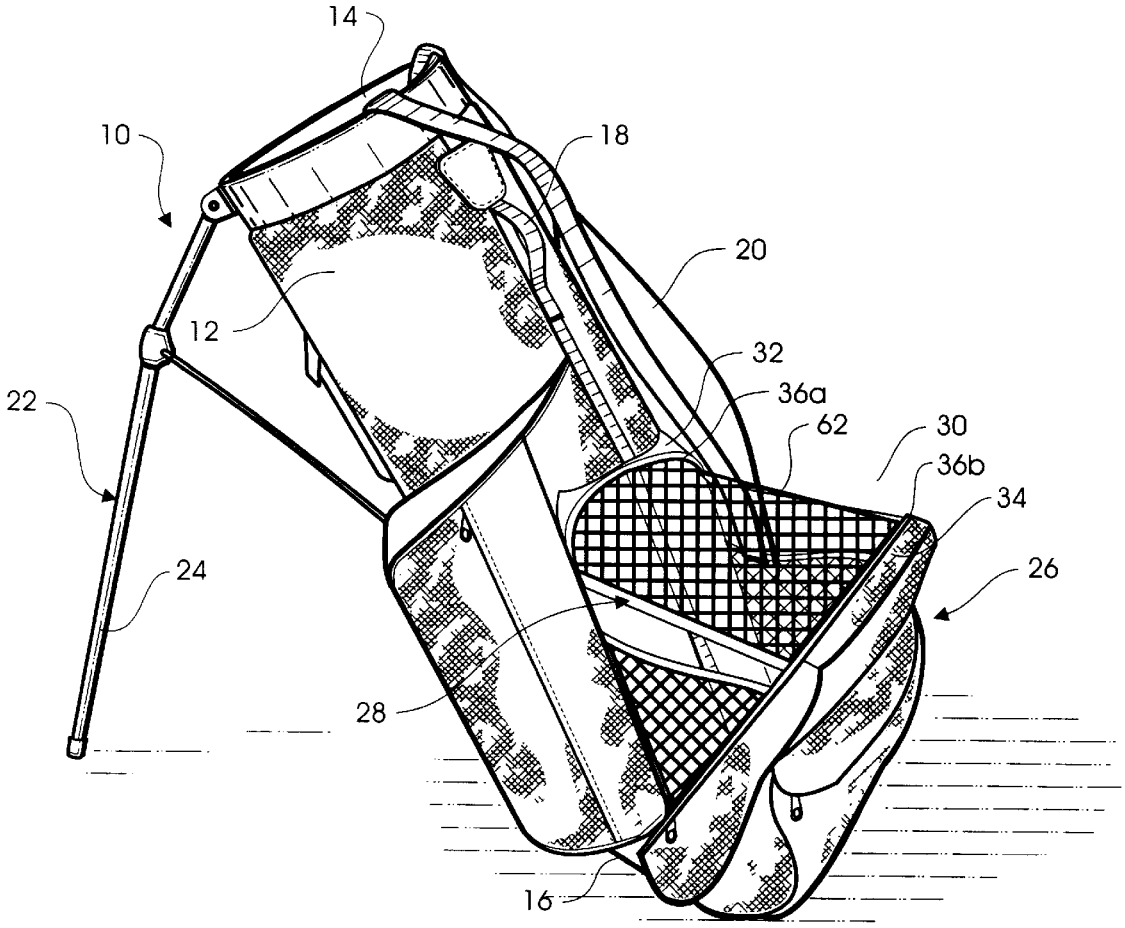
FIG. 1 is a perspective view of a golf bag incorporating the extensible seat assembly of the present invention.

Referring to the drawings, FIG. 1 shows a golf bag of the present invention which is referred to generally by reference numeral 10. The golf bag 10 is provided with a generally tubular body 12 having an open top end 14 through which golf clubs (not shown) may be inserted into and removed from the golf bag 10. The golf bag 10 is provided with a base member 16 which closes a bottom end of the tubular body 12, with the base member 16 being of special configuration as hereinafter described in more detail. The golf bag 10 further includes the usual handle 18 and a shoulder strap assembly 20. It will be understood that the shoulder strap assembly 20 may be a conventional single strap or a double strap type as shown and described in U.S. Pat. No. 5,954,255 to J. N. Beebe et al.

The golf bag 10 also includes a stand 22 which is used to support the tubular body 12 in a leaning but generally upright propped-up position when the golf bag 10 is resting on the ground. There are many golf bag stands of this general type in use with a typical one being disclosed in U.S. Pat. No. 4,834,235 to J. A. Solheim et al. Briefly, the stand 22 will be in a retracted position (not shown) when the golf bag 10 is being carried and, when in this retracted position, the legs 24 of the stand 22 will be in a generally parallel relationship with the tubular body 12 and proximate thereto. When the golf bag 10 is resting on the ground, the legs 24 of the stand 22 automatically move into an extended position as illustrated in FIG. 1 so that the body 12 is disposed in its leaning propped-up position at an acute angle of approximately 30 degrees relative to a plane perpendicular to the ground. This leaning attitude of the body 12 when in the propped-up position makes it possible for a golfer to sit on an extensible seat assembly 28 of the present invention without the golfer's back being in uncomfortable engagement with the body 12.

The golf bag 10 further includes a storage pocket 26 proximate a lower portion of the body 12 which is commonly referred to as a "ball pocket" because it is used to carry spare golf balls and other accessories the golfer may need. However, the storage pocket 26 is of special configuration so that it can contain the extensible seat assembly 28 of the present invention. The storage pocket 26 is provided with an opening 30 which divides the pocket 26 into an inner portion 32 which is affixed to an outer surface 33 of the tubular body 12 such as by sewing, and a movable outer portion 34. The inner and outer portions 32 and 34 respectively are provided with complimentary elements 36*a*, 36*b* of a zipper 36 for selective opening and closing of the pocket 26. The pocket 26 is specially configured so that it is large enough to contain the extensible seat assembly 28 which will accommodate an average size golfer.

Figure 2:
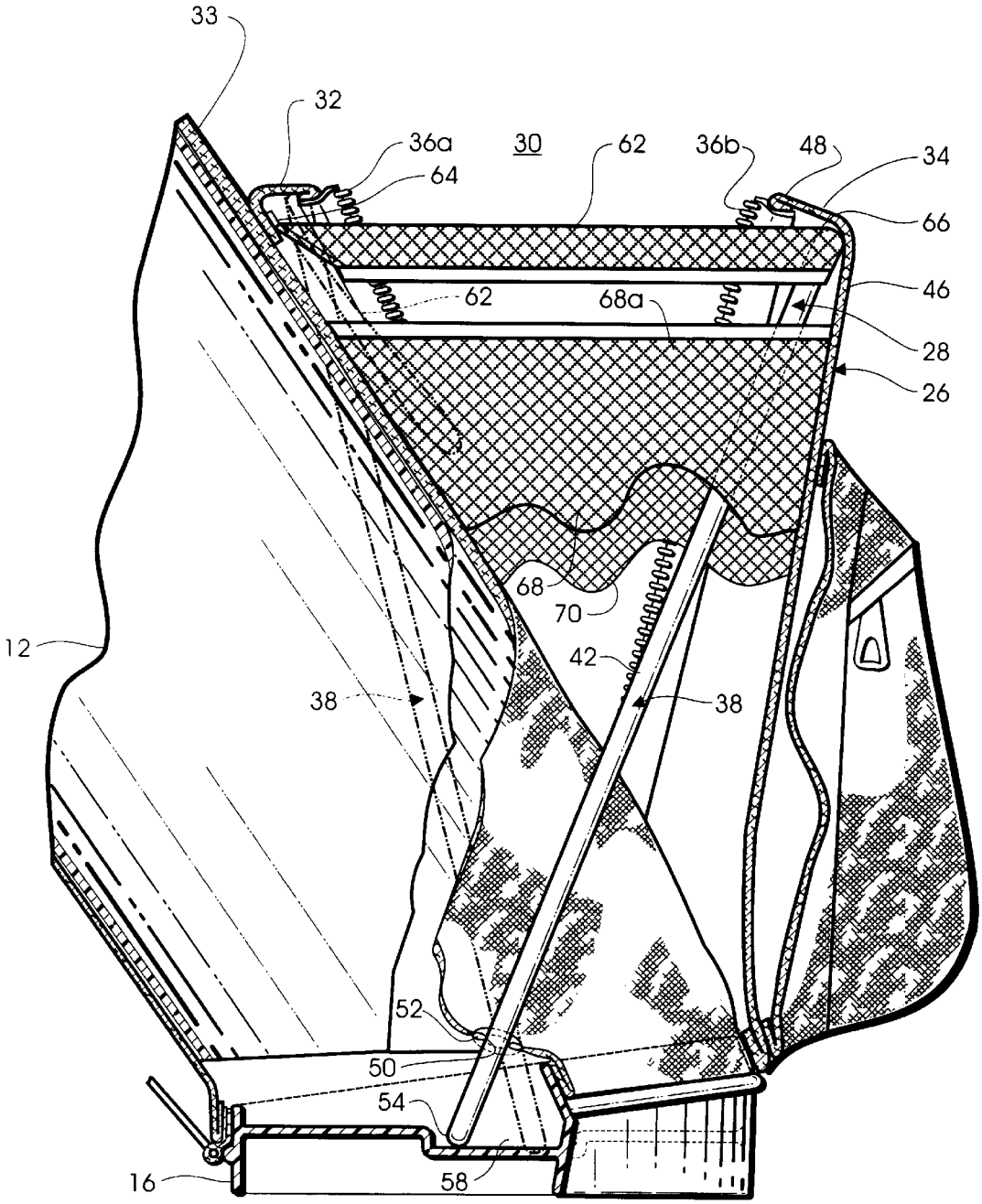
FIG. 2 is an enlarged fragmentary side elevational view of the golf bag shown in FIG. 1 with portions thereof being broken away to show the various features thereof.
Figure 3:
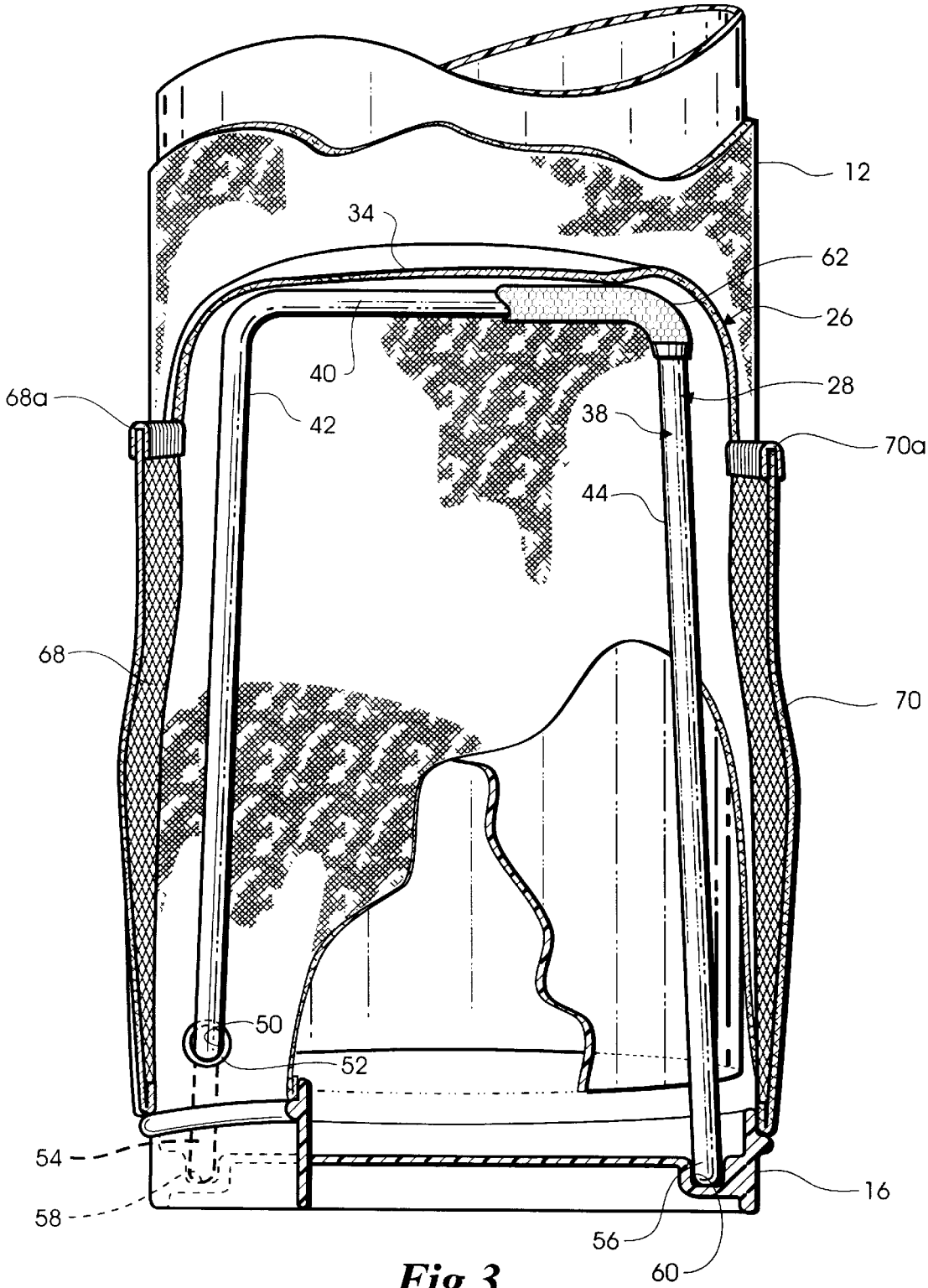
FIG. 3 is an enlarged fragmentary front elevational view of the golf bag shown in FIG. 1 with portions thereof being broken away to show the various features thereof.

As seen in FIGS. 2 and 3, the seat assembly 28 includes a generally U-shaped support rod 38 which is formed with a bight portion 40 and a pair of legs 42 and 44 which diverge and depend from opposite ends of the bight portion 40. The support rod 38 is movable between a retracted position proximate the body 12 and an extended position spaced away from the body 12. The bight portion 40 of the support rod 38 is disposed within an upper end of the movable portion 34 of the pocket 26 at an intersection of a front face 46 and a top edge 48 of the movable portion 34. The legs 42 and 44 of the support rod 38 extend downwardly through the pocket 26 and are disposed so as to substantially straddle the tubular body 12 and pass through suitable openings 50 (only one of which is shown in FIGS. 2 and 3) formed therein. The openings 50 are each provided with a suitable closing device, such as a grommet 52, to prevent small objects from passing from the pocket 26 into the base member 16 of the golf bag 10. Depending ends 54 and 56 of the support rod legs 42 and 44 extend into the body 12 and are disposed within upwardly opening grooves 58 and 60 that are formed in diametrically opposed sides of the base member 16. As seen in FIG. 2, the groove 58 is elongated and the depending end 54 of the leg 42 that is disposed therein is slidably movable in the groove 58. It will be understood that the other groove 60 is similarly elongated and the depending end 56 of the leg 44 disposed therein is slidably movable in the groove 60. By allowing the ends 54 and 56 of the legs 42 and 44 to slide in their respective grooves 58 and 60, a seating area of sufficient size for supporting most golfers will be provided and the arcuate movement of the bight portion 40 of the support rod 38 needed to achieve the desired seat area will be minimized.

A foldable seat 62, preferably formed of a four-sided sheet of suitable fabric, has one side 64 thereof affixed such as by sewing to an outer surface 33 of the tubular body 12 at a location within the storage pocket 26 and proximate the upper end of pocket inner portion 32. The seat 62 extends from the outer surface 33 of the tubular body 12 and has an opposite side 66 suitably attached to the bight portion 40 of the support rod 38, such as by being sewn in a wrapped around position on the support rod 38. A fabric that has been found to be suitable for use in forming the foldable seat 62 seat is identified as product No. TA84A Black Mesh available from Apex Mills of 168 Doughty Blvd., Inwood, N.Y., 11096.

With the pocket 26 open and the support rod 38 in its extended position as shown in solid lines in FIG. 2 extending away from the body 12, the foldable seat 62 will be in a taut stretched condition immediately below the opening 30 of the pocket 26. By moving the support rod 38 toward the tubular body 12 into its retracted position as indicated by the dashed lines in FIG. 2 proximate the body 12, the seat 62 will be in a folded condition.

When the storage pocket 26 is open, objects contained within the pocket 26 could easily fall out. To prevent this, foldable nets 68 and 70 are sewn or otherwise affixed to extend across opposing sides of the pocket 26. The nets 68 and 70 may be formed of the same material as the seat 62 and preferably, the upper ends 68*a*, 70*a* of the nets 68, 70 will be spaced below the foldable seat 62 to provide access to the pocket 26 when the seat assembly 28 is extended.

What is claimed is:

1. A golf bag comprising:

a generally tubular body for containing golf clubs;

a base member for closing a bottom end of said tubular body;

a storage pocket affixed to said tubular body proximate a lower portion thereof, said storage pocket having an opening which divides the storage pocket into a fixed inner portion and a movable outer portion;

a generally U-shaped support rod disposed in said storage pocket for movement between a retracted position proximate said tubular body and an extended position spaced away from said tubular body, said support rod having a bight portion located within an upper end of the movable outer portion of said storage pocket and a pair of legs depending from opposite ends of said bight portion, said pair of legs extending downwardly within said storage pocket with each of said pair of legs having a lower end, a spaced apart pair of openings formed in said tubular body proximate the lower portion thereof which extend from inside said tubular body into said storage pocket, each of said pair of legs extending through one of said pair of openings so that depending ends of said pair of legs are disposed within the lower portion of said tubular body; and a foldable seat carried within said storage pocket proximate the opening thereof, said foldable seat being connected between said tubular body and said support rod for movement between a folded condition when said support rod is in its retracted position and a taut stretched condition when said support rod is in its extended position.

2. A golf bag as claimed in claim 1, wherein said support rod is generally U-shaped and comprises:

a bight portion located within an upper end of the movable outer portion of said storage pocket; and a pair of legs depending from opposite ends of said bight portion.

3. A golf bag as claimed in claim 1, wherein said foldable seat is formed of mesh fabric.

4. A golf bag as claimed in claim 1, further comprising:

said base member having a pair of spaced apart grooves formed in opposed sides thereof; and each of the depending ends of said pair of legs being disposed in one of said pair of grooves and slidably movable therein when said support rod is moved between its retracted and extended positions.

5. A golf bag as claimed in claim 4, further comprising a pair of grommets located in said pair of openings and each of said grommets circumscribingly engaging one of said pair of legs to prevent small objects from exiting said storage pocket into said tubular body.

6. A golf bag as claimed in claim 1, wherein said foldable seat is formed of fabric.

7. A golf bag comprising:

a generally tubular body for containing golf clubs;

a base member for closing a bottom end of said tubular body;

a storage pocket affixed to said tubular body proximate a lower portion thereof, said storage pocket having an opening which divides the storage pocket into a fixed inner portion and a movable outer portion, said storage pocket opening extending across a top end of said storage pocket and along opposite sides of said storage pocket to form side openings in said storage pocket;

a support rod disposed in said storage pocket for movement between a retracted position proximate said tubular body and an extended position spaced away from said tubular body;

a foldable seat carried within said storage pocket proximate the opening thereof, said foldable seat being connected between said tubular body and said support rod for movement between a folded condition when said support rod is in its retracted position and a taut stretched condition when said support rod is in its extended position; and a pair of foldable nets each attached to the fixed inner and movable outer portions of said storage pocket so that said pair of nets each span one of the side openings formed in said storage pocket to prevent objects from falling out of said storage pocket when it is open.

8. A golf bag as claimed in claim 7, wherein each of said pair of nets has a top edge which lies in downwardly spaced relationship with respect to said foldable seat to provide access into said storage pocket when said storage pocket is open.

9. A golf bag comprising:

a tubular body for containing golf clubs;

a base member for closing a bottom end of said tubular body;

a storage pocket affixed to an outer surface of the tubular body proximate a lower portion thereof, said storage pocket having an opening extending across a top end thereof and along opposite sides thereof to divide said storage pocket into a fixed inner portion and a movable outer portion and to provide side openings in said storage pocket;

a generally U-shaped support rod disposed in said storage pocket and movable between a retracted position proximate said tubular body and an extended position spaced away from said tubular body, said support rod including a bight portion and a pair of legs depending from opposite ends of the bight portion, said pair of legs each having a depending end;

said tubular body having a spaced apart pair of openings formed proximate the lower portion thereof which extend from inside said tubular body into said storage pocket;

said pair of legs of said support rod each extending through one of said pair of openings so that the depending ends of said pair of legs are disposed within the lower portion of said tubular body;

said base member including a pair of upwardly opening spaced apart grooves formed in opposed sides thereof;

each of the depending ends of said pair of legs being disposed in one of said pair of grooves and slidably movable therein when said support rod is moved between its retracted and extended positions; and a foldable seat carried within said storage pocket proximate the top end thereof, said foldable seat having one side affixed to the outer surface of said tubular body and an opposite side attached to said support rod for movement therewith between a folded condition when said support rod is in its retracted position and a taut stretched condition when said support rod is in its extended position.

10. A golf bag as claimed in claim 9, further comprising a pair of grommets located in said pair of openings formed in said tubular body, and each of said pair of grommets circumscribingly engaging one of said pair of legs to prevent small objects from exiting said storage pocket said tubular body.

11. A golf bag as claimed in claim 9, wherein said foldable seat is formed of fabric.

12. A golf bag as claimed in claim 9, wherein said foldable seat is formed of mesh fabric.

13. A golf bag as claimed in claim 9, further comprising a pair of foldable nets each attached to the fixed inner and movable outer portions of said storage pocket so that said pair of nets span the side openings formed in said storage pocket to prevent objects from falling out of said storage pocket when it is open, each of said pair of nets having a top edge which lies in downwardly spaced relationship with respect to said foldable seat to provide access into said storage pocket when said storage pocket is open.

14. A golf bag as claimed in claim 9, further comprising a stand for supporting said tubular body at an acute angle of approximately 30 degrees relative to a plane perpendicular to the ground when the tubular body is resting on the ground.

* * * * *